US006918455B2

(12) United States Patent
Meyers et al.

(10) Patent No.: US 6,918,455 B2
(45) Date of Patent: Jul. 19, 2005

(54) DRILL BIT WITH LARGE INSERTS

(75) Inventors: John Adam Meyers, The Woodlands, TX (US); Carl W. Keith, Houston, TX (US); Huy D. Bui, Houston, TX (US)

(73) Assignee: Smith International, Houston, TX (US)

( * ) Notice: Subject to any disclaimer, the term of this patent is extended or adjusted under 35 U.S.C. 154(b) by 0 days.

(21) Appl. No.: 09/104,788

(22) Filed: Jun. 25, 1998

(65) Prior Publication Data

US 2001/0047890 A1 Dec. 6, 2001

Related U.S. Application Data

(60) Provisional application No. 60/051,280, filed on Jun. 30, 1997.

(51) Int. Cl.[7] ..... E21B 10/36; E21B 10/56

(52) U.S. Cl. ..... 175/420.2; 175/420.1; 175/426; 175/415

(58) Field of Search ..... 175/420.2, 420.1, 175/414, 415, 417, 418, 426, 398, 400

(56) References Cited

U.S. PATENT DOCUMENTS

| | | | | | |
|---|---|---|---|---|---|
| 3,185,228 | A | * | 5/1965 | Kelly, Jr. | 175/426 |
| 3,583,504 | A | * | 6/1971 | Aalund | 175/398 |
| 3,693,736 | A | * | 9/1972 | Gardner | 175/426 |
| 3,788,409 | A | * | 1/1974 | Curington | 175/426 |
| 3,918,538 | A | * | 11/1975 | Bender | 175/426 |
| 3,955,635 | A | * | 5/1976 | Skidmore | 175/400 |
| 4,106,578 | A | | 8/1978 | Beyer | |
| 4,304,312 | A | * | 12/1981 | Larsson | 175/400 |
| 4,572,307 | A | * | 2/1986 | Tunell | 175/417 |
| 4,598,779 | A | * | 7/1986 | Liljekvist et al. | 175/415 |
| 4,607,712 | A | * | 8/1986 | Larsson | 175/426 |
| 4,716,976 | A | * | 1/1988 | Isakov | 175/415 |
| 4,805,705 | A | * | 2/1989 | Liljebrand et al. | 173/80 |
| 4,811,801 | A | | 3/1989 | Salesky | |
| 5,335,738 | A | * | 8/1994 | Waldenstrom et al. | 175/420.2 |
| 5,370,195 | A | * | 12/1994 | Keshavan et al. | 175/420.2 |
| 5,575,342 | A | | 11/1996 | Hedlund et al. | 175/57 |
| 5,794,728 | A | * | 8/1998 | Palmberg | 175/400 |
| 5,890,551 | A | * | 4/1999 | Liljebrand et al. | 175/418 |
| 5,984,030 | A | * | 11/1999 | Larsson et al. | 175/414 |

FOREIGN PATENT DOCUMENTS

| | | |
|---|---|---|
| EP | 0140849 | 5/1985 |
| EP | 0511547 | 12/1996 |
| GB | 1228679 | 4/1971 |
| GB | 1276249 | 6/1972 |
| GB | 1443092 | 7/1976 |
| GB | 1507163 | 4/1978 |
| GB | 2293840 | 4/1996 |
| GB | 2296267 | 6/1996 |
| GB | 2294072 | 4/1998 |
| GB | 2301852 | 6/1999 |

OTHER PUBLICATIONS

Sandvik Rock Tools Percussive Hammers and Bits Trouble Shooting Guide, 1994;71–73,76–79, & 81–85; published in the USA.

* cited by examiner

*Primary Examiner*—Hoang Dang
(74) *Attorney, Agent, or Firm*—Osha Liang LLP

(57) ABSTRACT

A percussion drill bit is provided that has at least two different pluralities of inserts extending from the bit head to better match the conditions seen on the bit head during drilling. The preferred embodiment has a plurality of large inserts with a polycrystalline diamond layer located at least in the gage row and a plurality of smaller inserts located at least in the inner rows.

62 Claims, 10 Drawing Sheets

DRILL BIT WITH LARGE INSERTS

CROSS-REFERENCE TO RELATED APPLICATIONS

This application claims the benefit of U.S. Provisional Application No. 60/051,280, filed Jun. 30, 1997.

TECHNICAL FIELD OF THE INVENTION

The present invention relates to earth boring drill bits, such as percussion bits, having large inserts extending from certain portions of the bit face.

BACKGROUND OF THE INVENTION

Referring initially to FIG. 1, a prior art percussion drill bit 10 is shown having a bit head 12 that includes a bit face 14 and a multitude of inserts 20 for impacting and fracturing the earthen formation (not shown). Inserts 20 were typically disposed on various portions of the bit face 14. For example, inserts 20 are shown disposed on the central portion 19 of the bit face 14 in the proximity of the central axis 13 of the bit 10, and other inserts 20 are disposed in numerous circumferential rows 70 on the bit face 14, such as a first row 72, second row 74, third row 76 and gage row 78. The term "gage row" as used herein refers to the row 70 extending around, or adjacent, the periphery, or edge, 15 of the bit face 14. All of the inserts 20 on the bit face 14 of the prior art hammer bit 10 had substantially the same geometric shape and size, such inserts 20 being referred to herein as "small" inserts 22. Typically, such inserts 22 had a diameter of 0.75 inches or smaller. The bit face 14 also included one or more fluid flow openings 16 and flow channels 18 for allowing the flow of circulation fluid (not shown) from within the bit 10 to the exterior 44 of the bit 10.

Different places on the bit head may see different conditions during drilling yet the same inserts typically are used at all places of the bit head of the prior art. A need exists for a drill bit with different inserts at different places on the bit head to better match the varying conditions or applications of different places on the bit head.

SUMMARY OF THE INVENTION

In one aspect of the present invention, a percussion drill bit for percussive drilling in a formation is provided that comprises a bit head for percussive impact against the formation with at least a first plurality of first inserts and a second plurality of second inserts extending from the bit head. Each of the first inserts have a first base portion mounted to the bit head and a first exposed portion extending from the bit head with the first exposed portion having a first profile. Each of the second inserts have a second base portion mounted to the bit head and a second exposed portion extending from the bit head with each of the second exposed portions having a second profile that is appreciably different from the first profile of the first exposed portion. At least some of the second exposed portions enhanced with a superhard material.

In other aspects of the present invention, the second inserts may also vary from the first inserts by radius of curvature of the exposed portions and/or by diameter of the base portion.

BRIEF DESCRIPTION OF THE DRAWINGS

For a detailed description of the preferred embodiments of the invention, reference will now be made to the accompanying drawings wherein.

DESCRIPTION OF THE PREFERRED EMBODIMENTS

Figure 1:
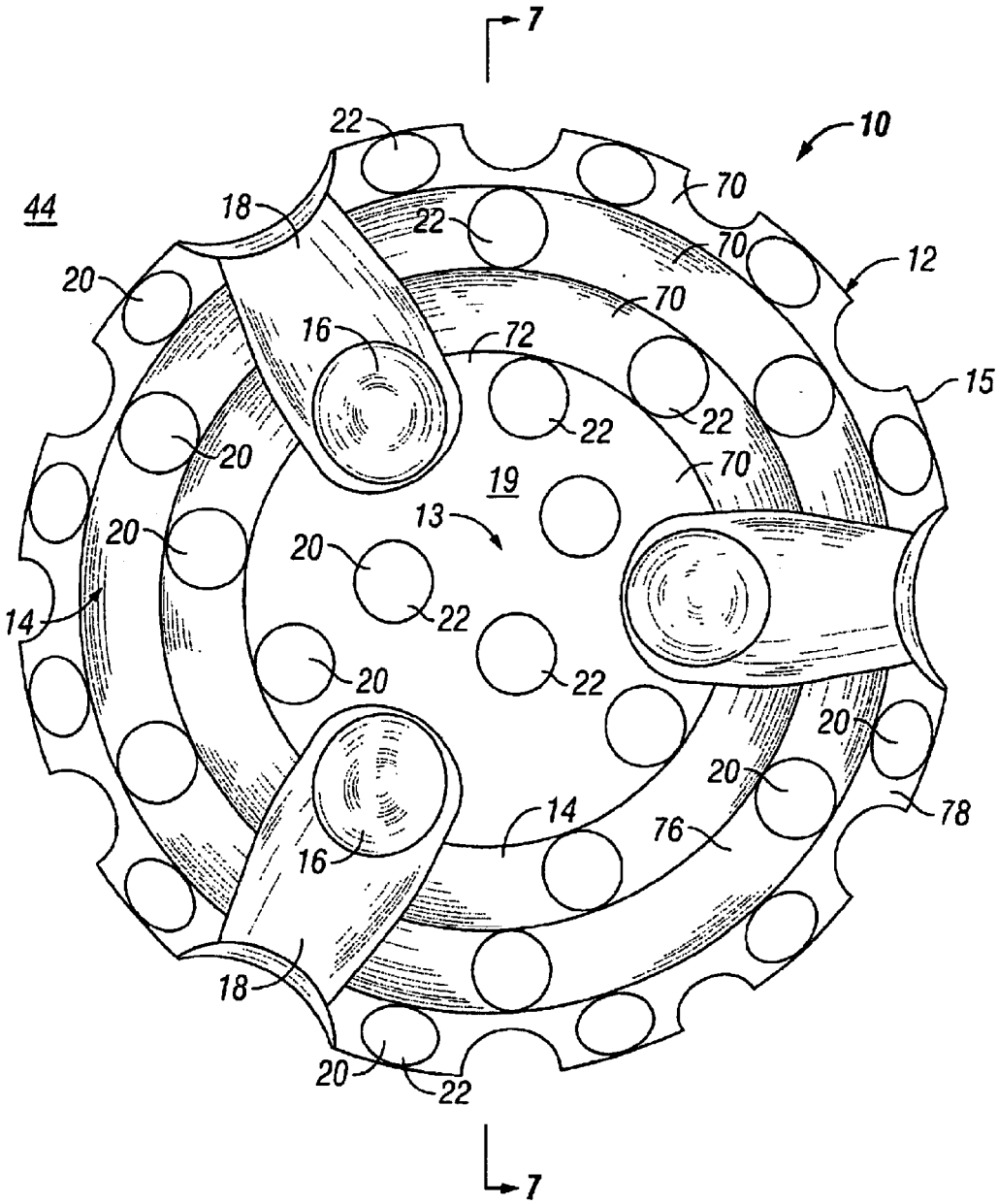
FIG. 1 (Prior Art)
FIG. 1 is a front view of a percussion drill bit of the prior art.

Presently preferred embodiments of the invention are shown in the above-identified figures and described in detail below. In illustrating and describing the presently preferred embodiments, like or identical reference numerals are used to identify common or similar elements. The figures are not necessarily to scale and certain features and certain views of the figures may be shown exaggerated in scale or schematic form in the interest of clarity and conciseness.

Figure 2:
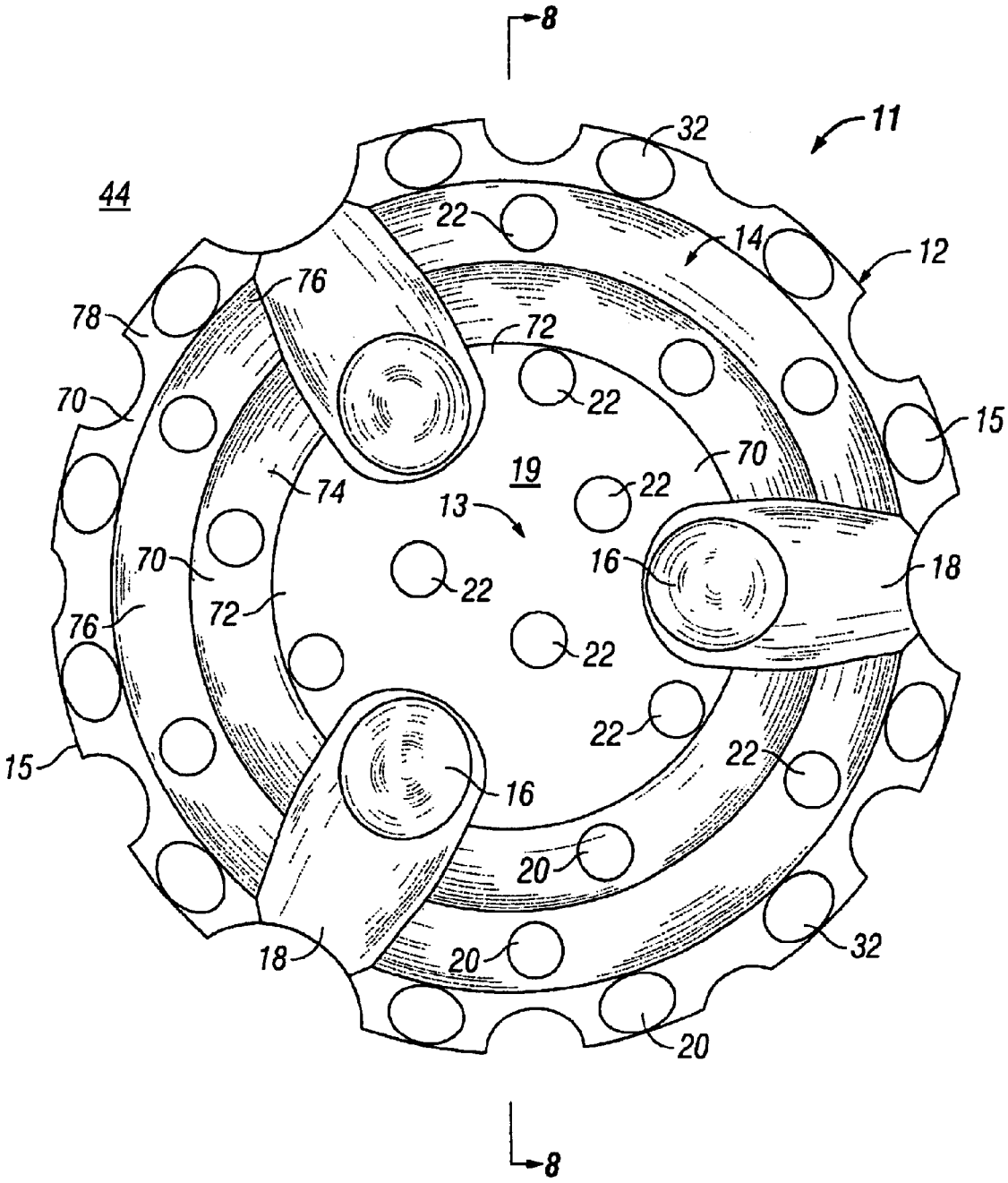
FIG. 2 is a front view of a percussion drill bit having large inserts on the gage row made in accordance with the present invention.
Figure 3:
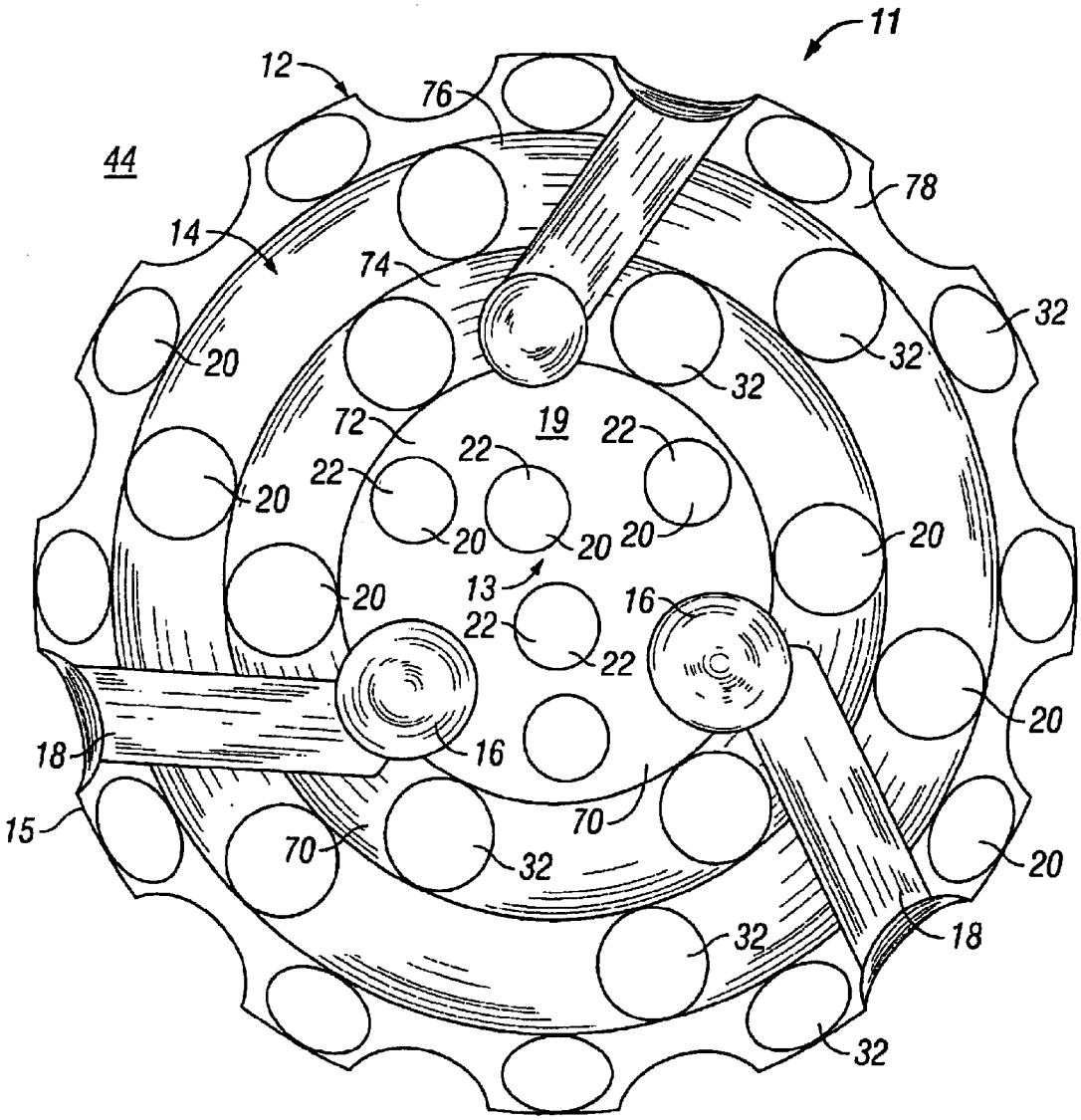
FIG. 3 is a front view of another embodiment of the present invention having a large insert across the bit face, except for the inserts on the central portion of the bit.

The percussion bit 11 of the present invention, as shown, for example, in FIGS. 2 and 3, also has a bit head 12, a bit face 14 and a multitude of inserts 20. It should be understood that while the present invention is shown and described herein with respect to percussion bits, which are useful with percussion drilling assemblies, such as those shown and described in U. S. Pat. No. 5,322,136 to Bui et al., U.S. Pat. No. 4,932,483 to Rear and U.S. Pat. No. 4,819,739 to Fuller, the invention is not limited to percussion bits and may be used with any other type of earth boring drill bit having cutting elements for impacting, fracturing or crushing an earthen formation. The inserts 20 of the bit 11 are shown disposed on various portions of the bit face 14. Inserts 20 are disposed on the central portion 19 of the bit face 14 in the proximity of the central axis 13 of the bit 11, and other inserts 20 are disposed on numerous circumferential rows 70, such as a first row 72, second row 74, third row 76 and gage row 78. It should be understood that the present invention is not limited to having inserts 20 disposed in these particular locations on the bit face 14, or in the quantities shown.

Figure 9:
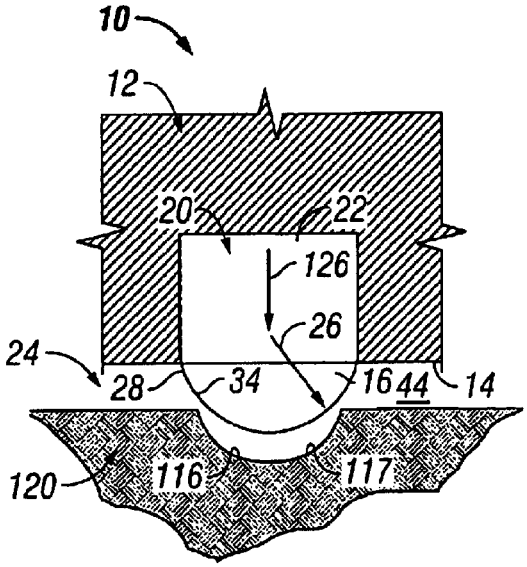
FIG. 9 (Prior Art)
FIG. 9 is an isolated view of an insert of the prior art drill bit of FIG. 1 and the earthen formation impact crater created thereby.

Still referring to FIGS. 2 and 3, the bit 11 of the present invention includes small inserts 22 and "large" inserts 32. The large inserts 32 have a larger geometric size, a larger radius of curvature 36 (FIG. 10) and larger contact surface 38 (FIG. 10), as compared to the geometric size, radius of curvature 26 and contact surface 28 of the small inserts 22 (FIG. 9). The "contact surface" is that portion of the insert face surface 39 (FIGS. 9, 10) that engages the formation 120. Generally, the larger the insert face surface 39, the larger the "contact surface".

In FIG. 2, for example, the inserts 20 on the gage row 78 are large inserts 32, while all other inserts 20 shown on the bit face 14 are small inserts 22. In FIG. 3, all of the inserts 20 on the bit face 14 are large inserts 32, except the inserts 20 disposed on the central portion 19 of the bit face 14 proximate to the central axis 13 and the inserts 20 on row 72, which are small inserts 22. The present invention is, however, not limited to the particular combinations of large and small inserts 32, 22 shown in FIGS. 2 and 3, but encompasses any configuration of inserts 20 that includes large and small inserts 32, 22 capable of providing one or more of the aspects, or benefits, of the invention described herein.

Figure 6:
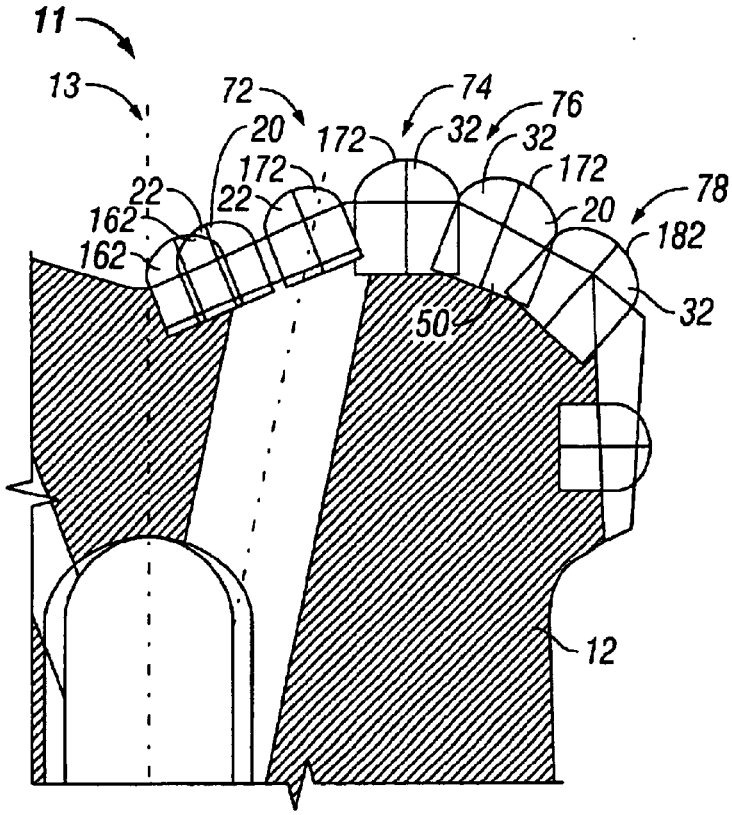
FIG. 6 is a partial profile view of the percussion drill bit of FIG. 3.
Figure 5:
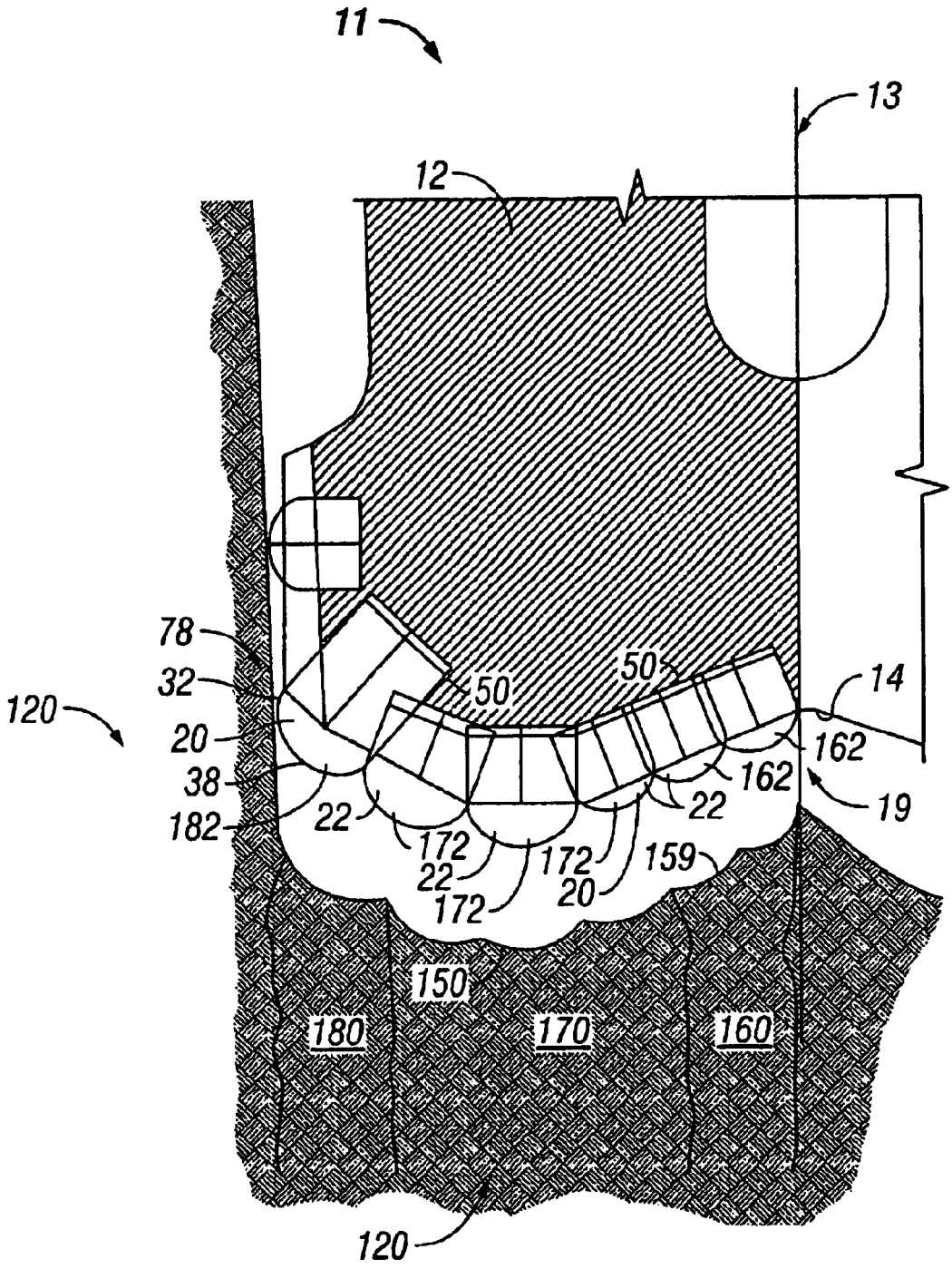
FIG. 5 is a partial profile view of the percussion drill bit of FIG. 2.

Now referring to FIGS. 5 and 6, the inserts 20 are preferably embedded, or emplaced, in cavities 50 in the bit head 12. The inserts 20 may possess any among a variety of geometric shapes, such as, for example, semi-round top, chisel and conical shaped inserts, as are or become known in the art. Further, any among a variety of types of inserts 20 that are or become known in the art may be used as small and large inserts 22, 32, such as, for example, tungsten carbide inserts, tungsten carbide inserts having a super-abrasive surface, such as polycrystalline diamond ("PCD") or cubic boron nitride ("PCBN"), and inserts constructed of a matrix of tungsten carbide and other material. The bit 11 of the present invention, as shown, for example, in FIGS. 5 and 6, preferably includes small inserts 22 having a diameter of 0.75 inches or smaller, and large inserts 32 having a diameter of over 0.75 inches, such as 22 millimeters. However, the present invention is not limited to the use of inserts 22, 32 of those sizes, but encompasses any suitable type of inserts 22, 32, of any suitable sizes so long as the large inserts 32 are larger than the small inserts 22, and the bit 11 is capable of providing one or more of the aspects, or benefits, of the invention described herein.

FIG. 5 further illustrates a typical bottom hole pattern 150 of the earthen formation 120 formed by bit 11. The bottom hole pattern 150 is shown generally divided into segments 160, 170 and 180, which differ with respect to the loading conditions on the inserts 20 of the bit face 14. Segment 160 represents the portion of the bottom hole pattern 150 most radially inboard relative, or proximate, to the central axis 13 of the bit 11. This segment 160 corresponds with, or is engaged by, the inserts 20 disposed on the central portion 19 of the bit face 14. These inserts 20 will be referred to as inserts 162. Segment 180 represents the bottom hole pattern 150 most radially outboard relative to, or farthest from, the central axis 13 of the bit 11. This section 180 corresponds with, or is engaged by, the inserts 20 on the gage row 78 (inserts 182). Segment 170 represents the portion of the bottom hole pattern 150 disposed between segments 160 and 180, and corresponds with, or is engaged by, the inserts 20 disposed on the bit face 14 between the gage row 78 and the central portion 19, and will be referred to as inserts 172.

Figure 4:
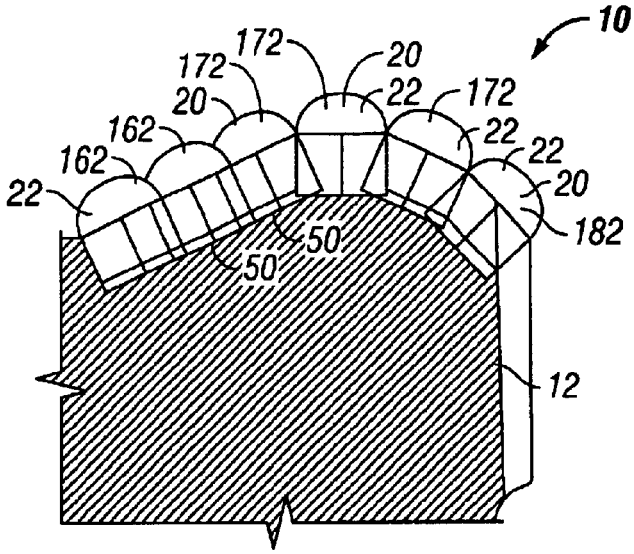
FIG. 4 (Prior Art)
FIG. 4 is a partial profile view of the prior art percussion drill bit of FIG. 1.

Still referring to FIG. 5, it is known that when the earthen formation 120 includes substantial amounts of rock, the compressive strength of the formation 120 across the bottom hole pattern 150 increases substantially from segment 160 to segment 180 due to the confining pressure and the overburden pressure. Segment 180 thus generally possesses the highest compressive strength followed by segment 170, which is followed by segment 160, which has the lowest compressive strength. This places increasing load requirements on the inserts 162, 172 and 182 for fracturing or crushing the formation 120. Thus, the bit 11 requires less load directed to inserts 162 to fracture or crush the formation 120 than to inserts 172, and much less load than needs to be directed to inserts 182, due to the gradient in compressive strength of the formation 120 from segments 160-180. Uniform distribution of the load across the entire bit face 14; such as with the prior art bit 10 of FIG. 4, results in inefficient drilling.

In accordance with the present invention, it has been discovered that the use of large inserts 32 on certain areas of the bit face 14, as shown, for example in FIGS. 2 and 3, will optimize bit performance in view of the gradient in compressive strength of the earthen formation 120 (FIG. 5) across the bottom hole pattern 150. In FIG. 5, the gage row inserts 182 are large inserts 32. The large contact surfaces 38 of the large inserts 32 enables the distribution of sufficient increased load to segment 180 to overcome its higher strength, thus increasing drilling efficiency. The durability and survivability of the inserts 182 is preserved, or enhanced, because of the increased physical size, or robustness, and the larger radius of curvature 36 (FIG. 10) of the large inserts 32. The forces upon the large inserts 32 of bit 11 from their interaction with the earthen formation 120 will be imparted across the larger, or broader, contact surface 38 of the insert 32 as compared to the contact surface 28 of the small inserts 22 (FIG. 9). As a result, the inserts 32 will be less susceptible to damage from interaction with the formation 120 and more durable than the inserts 22.

Referring to FIG. 6, large inserts 32 are shown as inserts 172 on rows 74 and 76 in addition to large inserts 32 on the gage row 78 (inserts 182). The benefits described above with respect to FIG. 5 will apply to this configuration, but to a lesser magnitude with respect to inserts 172 on rows 74 and 76 because the gradually increasing compression strength and reaction forces of segment 170 (not shown) are not as great as those of segment 180 (not shown), causing less increased load demand. In contrast, the use of small inserts 22 as inserts 162 and inserts 172 on row 72 provides sufficient load and penetration to fracture or crush the corresponding formation 120 and efficiently drill the bore hole (not shown), whereas the use of large inserts (not shown) at those locations may lead to inefficient drilling.

Figure 11:
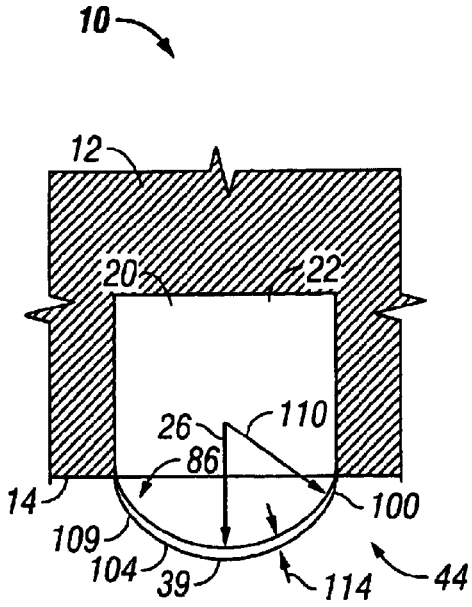
FIG. 11 (Prior Art)
FIG. 11 is an isolated view of an insert having an enhanced surface of a drill bit made in accordance with the prior art.
Figure 12:
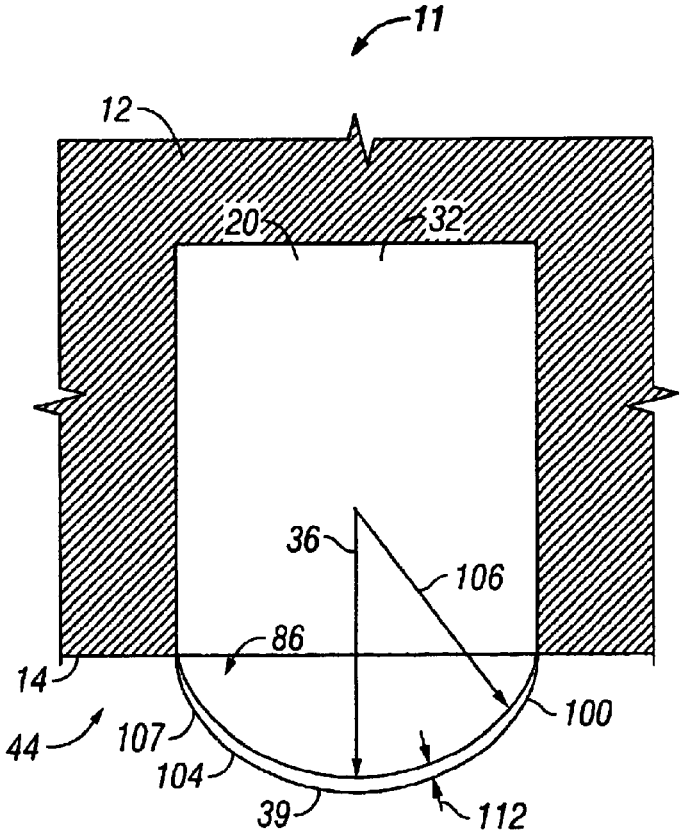
FIG. 12 is an isolated view of an insert having an enhanced surface of a drill bit made in accordance with the present invention.

Now referring to FIGS. 11 and 12, inserts 20 may be used that include an enhanced surface 100, which is known to generally increase insert longevity and improving bit performance. For example, tungsten carbide inserts having a PCD surface 104, such as those disclosed in U. S. Pat. No. 4,694,918 to Hall and U.S. Pat. No. 4,811,801 to Salesky et al., which are hereby incorporated by reference herein in their entireties, may be used. When inserts 20 are used having an enhanced surface 100, the surface 100 is subject to similar loading conditions as discussed above. The use of large inserts 32 having an enhanced surface 100 in accordance with the present invention provides additional benefits to those described above.

Figure 13:
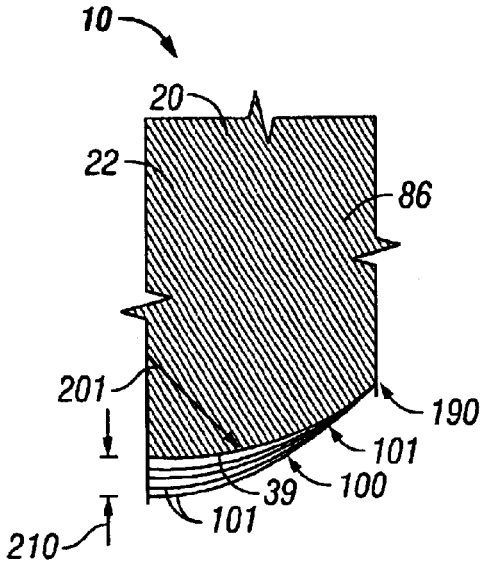
FIG. 13 (Prior Art)
FIG. 13 is a cross sectional view of a portion of the insert of FIG. 11 showing the various layers of the enhanced surface and the edge, or joint area, formed around the periphery of the enhanced surface.
Figure 14:
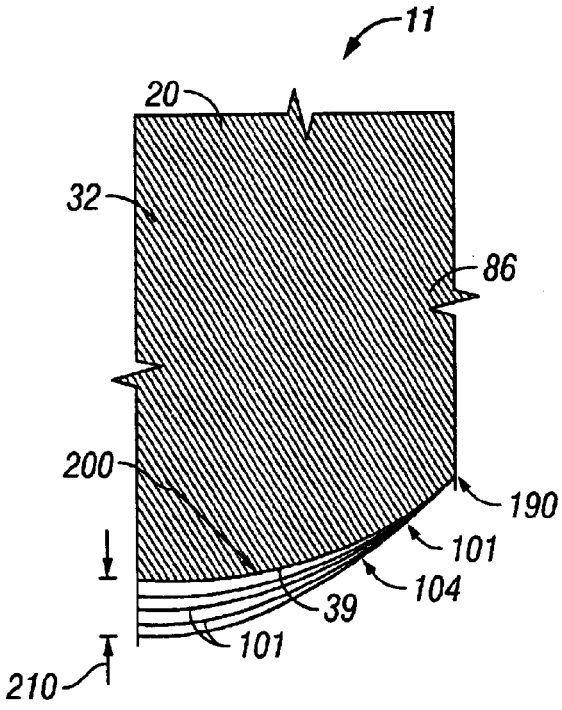
FIG. 14 is a cross sectional view of a portion of the insert of FIG. 12 showing the various layers of the enhanced surface and the edge, or joint area, formed around the periphery of the enhanced surface.
Figure 15:
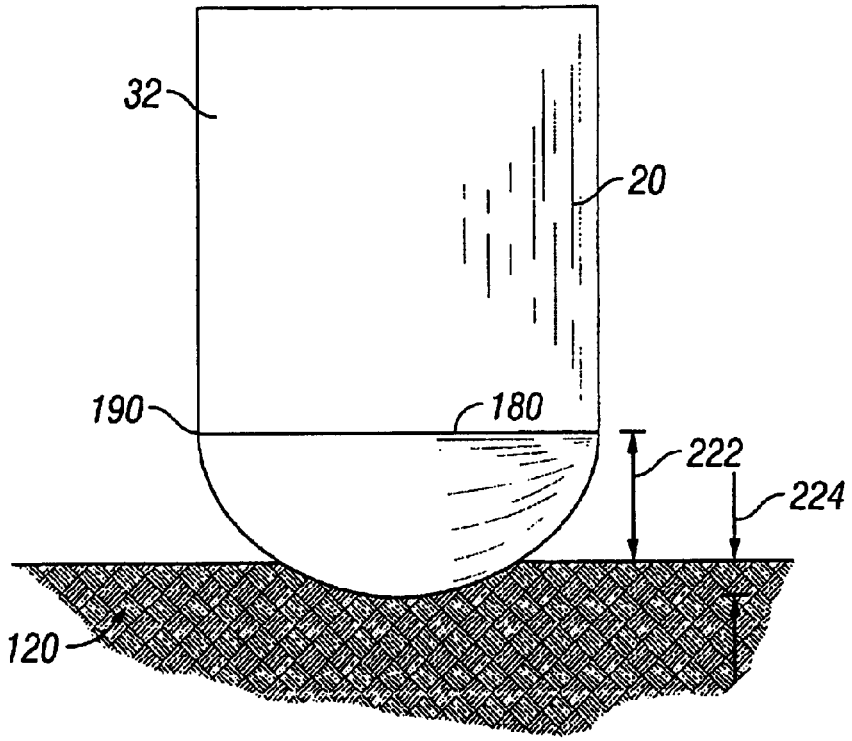
FIG. 15 is an isolated view of a large insert of the drill bit of FIG. 3 disposed in the earthen formation.
Figure 16:
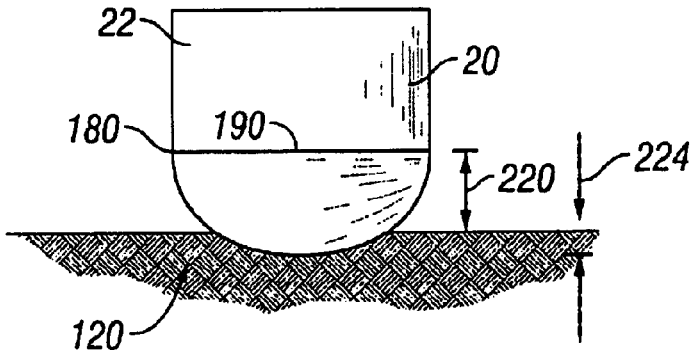
FIG. 16 (Prior Art)
FIG. 16 is an isolated view an insert of the prior art drill bit of FIG. 1 disposed in the earthen formation at the same depth as the insert of FIG. 15.

Referring to FIGS. 13 and 14, the enhanced surface 100 may include one, or numerous, layers 101 of enhanced material disposed upon the insert face surface 39. An edge, or joint area, 190 is formed around the periphery of the enhanced surface 100 where the surface 100 begins, or blends into the insert substrate material, such as tungsten carbide, 86. The edge, or joint area, 190, is subject to cracking, flaking and breakage when contacted with the earthen formation, which can lead to breakage and failure of the enhanced surface 100. In accordance with the present invention, the edge, or joint area, 190, of the enhanced surface 100 is protected from contact with the earthen formation 120 as the insert 32 impacts, or interacts with, the formation 120. As shown in FIGS. 15 and 16, the distance 222 between the enhanced surface edge, or joint area, 190 of large insert 32 and the earthen formation 120 is greater than the distance 220 between the enhanced surface edge, or joint area, 190 of small insert 22 and the formation 120 at uniform depths of penetration 224, decreasing the susceptibility of the enhanced surface edge, or joint area, 190 of the larger inserts 32 to contact with the formation 120.

Referring back to FIGS. 11 and 12, the enhanced surface 100 of the large inserts 32 is larger and has a larger contact surface 107, as compared to the size and contact surface 109 of the enhanced surface 100 of a small insert 22. The forces on the enhanced surface 100 of the large inserts 32 of bit 11 from interaction with the earthen formation are imparted across the larger, or broader, contact surface 107. As a result, the enhanced surface 100 of inserts 32 are less susceptible to damage from interaction with the formation, and more durable than the enhanced surface 100 of inserts 22.

Still referring to FIGS. 11 and 12, in accordance with the present invention, a preferred method to increase the size of the contact surface 107 of the enhanced surface 100 of insert 32 is by increasing the radius of curvature 106 of the enhanced surface 100, which is done by increasing the radius of curvature 36 of the insert 32. An increase in the radius of curvature 106 of the enhanced surface 100, such as PCD surface 104, reduces the highly concentrated contact stresses on the enhanced surface 100 caused by interaction with the earthen formation. These contact stresses cause micro-chipping, spalling and fracture of the enhanced surface 100, which are major failure modes of inserts 20 having an enhances surface 100, such as a PCD surface 104. Thus, the enhanced surface 100 of inserts 32 will have reduced susceptibility to micro-chipping, spalling, and fracturing, preserving the integrity of the enhanced surface 100 and increasing its longevity.

Now referring again to FIGS. 13 and 14, during the manufacturing process of an insert 20 having a PCD surface 104, residual stress is generated in the PCD surface 104 and the tungsten carbide substrate 86 because of the mismatch of their differing thermal expansion coefficients. Such residual stress weakens the enhanced surface 104 and the tungsten carbide substrate 86 and increases the insert's 20 susceptibility to breakage and failure. The magnitude of this residual stress, however, is proportional to the ratio of the thickness 210 of the PCD surface 104 to the radius 200 (FIG. 14) of the substrate 86. In accordance with the present invention, the large insert 32 with a PCD surface 104 having a thickness 210 is designed with a larger substrate radius 200, as compared to the substrate radius 201 of a small insert 22 having a PCD surface 104 with a similar thickness 210, reducing the amount of residual stress.

Referring to FIGS. 11 and 12, another potential benefit from the invention is by reducing insert 20 failure due to irregular side impact loading on the inserts 20. Such loading can cause shear failure in the carbide substrate 86, which is known to be weaker under shear than under compression stresses. A large diameter insert 32 will better withstand irregular side impact loading, thus reducing shear stress on the insert 20. In another aspect of the invention, large inserts 32 are also better able to withstand impact loading from lateral movement, or vibration of the bit 11, as compared to small inserts 22.

Figure 10:
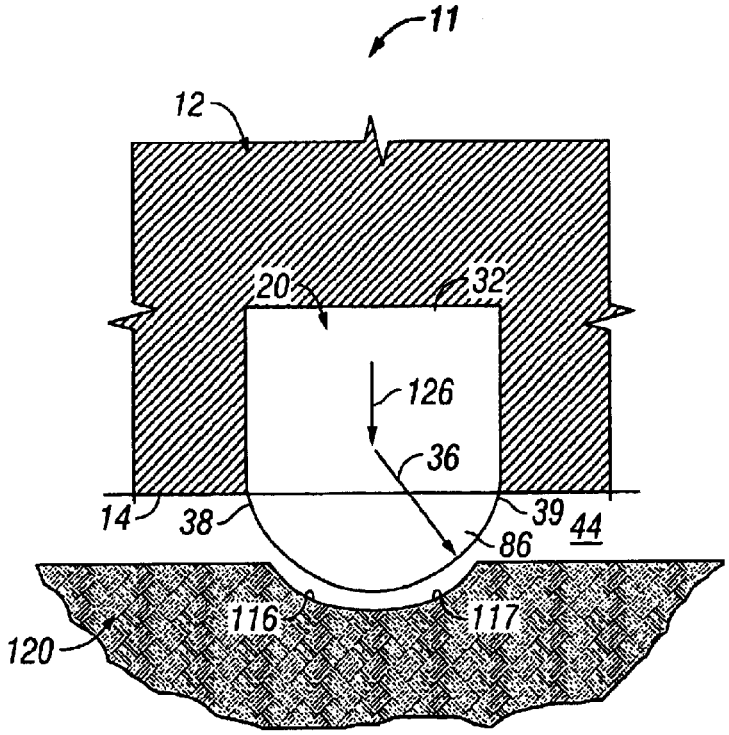
FIG. 10 is an isolated view of a large insert of the drill bit of FIG. 3 and the earthen formation impact crater created thereby.

In a further aspect of the invention, FIGS. 9 and 10 illustrate the general impact patterns in the earthen formation 120 caused by a prior art bit 10 and a bit 11 of the present invention, respectively. As shown in FIG. 9, insert 22 of the prior art bit 10 has a radius of curvature 26 and contact surface 28 that generally create an impact crater 116 in the earthen formation 120 upon contact. As the impact crater 116 is formed by the insert 22, a pronounced ledge 117 is generally created around the crater 116, serving as a barrier for the insert 22 to overcome as it rotates or indexes in the bore hole (not shown). The frictional engagement of the insert 22 and the ledge 117 imparts forces on the insert 22, which causes higher torque on the bit 10, increasing the bit's energy requirements and wear to the insert 22, while decreasing the bit's rate of penetration, or drilling. For percussion bits 10 used with certain types of percussion assemblies (not shown), such as, for example, those shown and described in U.S. Pat. No. 5,322,136 to Bui et al., excessive torque on the inserts 22, or bit 10, can cause the percussion assembly to stall, or become inoperable.

Now referring to FIG. 10, the contact surface 38 of the large inserts 32 of bit 11 is more gradually sloping as compared to the contact surface 28 of the small inserts 22 (FIG. 9). The large inserts 32 generally penetrate the earthen formation 120 less axially, or shallower, in the formation 120, as compared to the small inserts 22 (FIG. 9). A shallow crater 116 with gradually sloping walls and a small, or no, ledge 117 is created. As a result, the insert 32 advances across the formation 120 with less resistance and reduced torque on the bit 11.

Figure 7:
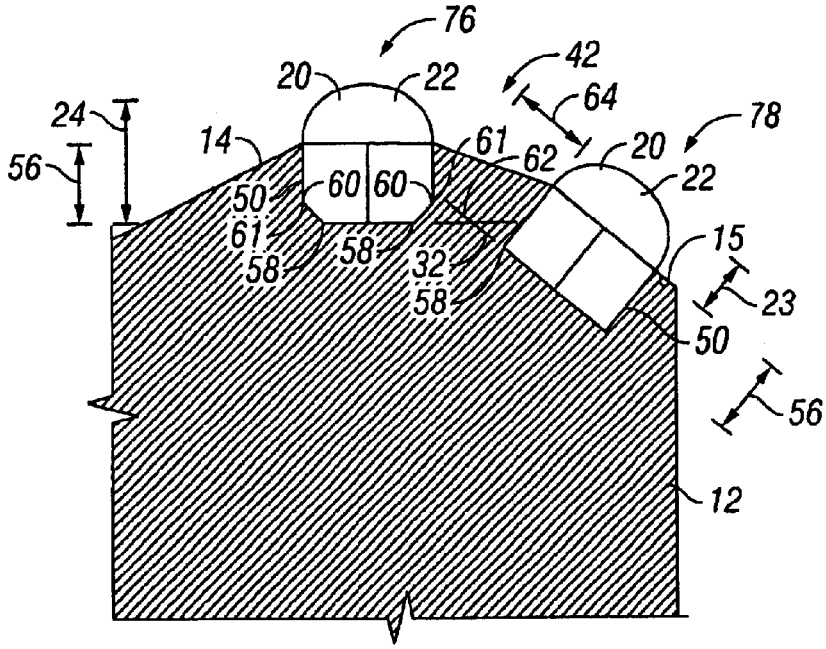
FIG.7 (Prior Art)
FIG. 7 is a partial cross-sectional view taken through line 7—7 of FIG. 1.
Figure 8:
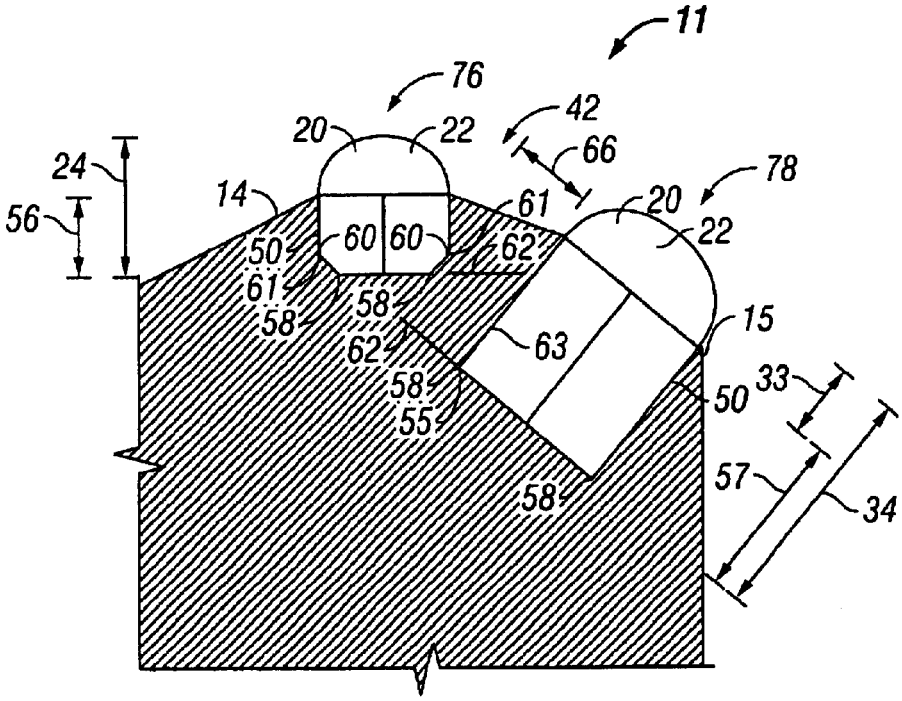
FIG. 8 is a partial cross-sectional view taken through line 8—8 of FIG. 2.

In another aspect of the invention, the large inserts 32 of the bit 11 may be formed with a length 34 that is greater than the length 24 of the small inserts 22, as shown, for example, in FIGS. 7 and 8. In turn, the inserts 32 can be configured such that the (longer) large inserts 32 extend farther away from the face 14 of the bit 11 than the small inserts 22. For example, large inserts 32 can be embedded in the head 12 of bit 11 at a depth 57 that allows the inserts 32 to extend farther from the bit face 14 than small inserts 22 embedded at a depth 56 in the head 12 of bit 10 or 11. As a result, the bit face 14 of bit 11 has a larger bit standoff 33 from formation (not shown), as compared to the standoff 23 of the prior art bit 10. The larger bit standoff 33 provides more open space volume 42 between inserts 20, and between the bit face 14 and the earthen formation (not shown) during drilling operations. This increased open space volume 42 allows an increased flow of circulating fluid across the bit face 14, enhancing the fluid's ability to clean the bit face 14, move cuttings up the bore hole (not shown) and cool the inserts 20, improving operational efficiency and bit longevity. Further, the increased flow of circulating fluid will reduce the velocity of the fluid across the face 14 of the bit 11 and around the inserts 20, reducing erosion to the bit face 14, bit head 12 and inserts 20, thus improving bit longevity.

It is generally known in the art that the bit head of a drill bit, such as a percussion bit, is subject to internal cracking from structural fatigue during normal operations. Referring again to FIGS. 7 and 8, when inserts 20 are disposed in the bit head 12 in cavities 50, the bit head 12 is susceptible to the formation of internal fatigue cracks (not shown) proximate to the cavities 50. In particular, it has been discovered that fatigue cracks tend to form in the bit head 12 at cavity base corners 58. Fatigue cracks also form at cavity side corners 60, which are located adjacent to a side corner, or change in shape, 61 of the corresponding insert 20, such as where the taper begins on an embedded tapered insert. The corners 58, 60 are highly susceptible locations for the formation, or initiation, of fatigue cracks. After such fatigue cracks form, they tend to migrate, or increase in size, along a path of least resistance through the bit head 12 during the continued use of the bit.

Still referring to FIGS. 7 and 8, catastrophic internal fatigue cracking can occur when inserts 20 are disposed in adjacent cavities at substantially uniform depths 56 in adjacent cavities 50, such as shown in the prior art bit 10 of FIG. 7. The term "catastrophic internal fatigue cracking" as used herein refers to breakage, or significant fracture, of the bit head 12, or loosening, or loss, of inserts 20, which can lead to premature bit failure. The term "adjacent cavities" refers to two or more cavities 50, whereby one cavity 50 is outward of and proximate to another cavity 50. The term "outward" as used herein means away from the central axis 13 of the bit 10 (FIGS. 1, 5) on the bit head 12, or face 14. As shown in FIG. 7, the adjacent cavities 50 of the prior art bit 10 are separated from one another by a short distance 64, or small section 65, of the bit head 12. Further, the adjacent corners 58 of cavities 50 have base planes 62 that intersect between the cavities 50 in bit section 65. As a result, fatigue cracks initiating at adjacent corners 58 have a close path of least resistance extending between adjacent cavities 50 and are susceptible to joinder with one another or with the adjacent cavity 50, which can lead to catastrophic internal fatigue cracking. The same problems exist for fatigue cracks initiating at adjacent side corners 60 of adjacent cavities 50 in prior art bit 10.

It has been discovered that the use of small and large inserts 22, 32, disposed in adjacent cavities 50 of bit 11, as shown, for example, in FIG. 8, will reduce the bit's susceptibility to, or will delay, catastrophic internal fatigue cracking as described above. In accordance with the present invention, the base planes 62 of adjacent cavities 50 carrying large and small inserts 32, 22 do not intersect in the bit section 65 between the cavities 50. Further, the adjacent base corners 58 of adjacent cavities 50 are separated by a distance 66 that is greater than the distance 64 of the adjacent base corners 58 of adjacent cavities 50 of the typical prior art bit 10 (FIG. 7). As a result, a close path of least resistance for cracks forming at corners 58 in bit 11, as in the prior art bit 10 (FIG. 7), is not created. Thus, the possibility of joinder of fatigue cracks forming at adjacent corners 58 and the likelihood of catastrophic internal fatigue cracking thereabouts is reduced, increasing bit integrity and longevity. The same effect will occur with respect to cracks forming at adjacent side corners 60 of adjacent cavities 50 of bit 11. While this aspect of the present invention applies to adjacent insert cavities 50 that carry large and small inserts 32, 22 anywhere on the bit 11, it is particularly significant with respect to adjacent cavities 50 located on the gage and third rows 78, 76 because the inserts 20, bit head 12 and cavities 50 at the gage row 78 are subject to heightened stress and fatigue and are thus more susceptible to fatigue cracking than other areas of the bit 11.

Each of the foregoing aspects of the invention may be used alone or in combination with other such aspects. The embodiments described herein are exemplary only and are not limiting of the invention, and modifications thereof can be made by one skilled in the art without departing from the spirit or teachings of this invention. Many variations and modifications of the embodiments described herein are thus possible and within the scope of the invention. Accordingly, the scope of protection is not limited to the embodiments described herein.

What is claimed is:

1. A percussion drill bit for percussive drilling in a formation, comprising:

(a) a bit head for percussive impact against the formation;

(b) at least a first plurality of first inserts and a second plurality of second inserts extending from the bit head;

(c) each of the first inserts having a first base portion that is not superhard mounted to the bit head and a first exposed portion extending from the bit head, the first exposed portion having a first profile and a first contact area;

(d) each of the second inserts having a second base portion mounted to the bit head and a second exposed portion extending from the bit head, each of the second exposed portions having a second profile that is appreciably different from the first profile and a second contact area that is appreciably different from the first contact area of the first exposed portion, at least some of the second exposed portions enhanced with a superhard material, wherein the bit head defines a first plurality of first cavities in which the first plurality of first inserts are disposed, and a second plurality of second cavities in which the second plurality of second inserts are disposed, wherein the depth of the second cavities is greater than the depth of the first cavities such that base planes of two adjacent cavities that are selected one each from the first cavities and the second cavities do not intercept in a bit section between the two adjacent cavities; and (e) wherein the bit head has a periphery with a gage row having at least some of the second inserts located therein, and the gage row further comprises at least some of the first inserts.

2. The drill bit of claim 1 wherein the plurality of first exposed portions and the plurality of second exposed portions are generally the same geometric shape with one of the pluralities of first and second exposed contact area appreciably larger than the other.

3. The drill bit of claim 2 wherein the second exposed portions are proportionally larger than the first exposed portions.

4. The drill bit of claim 1 wherein the first exposed portions are generally hemispherical.

5. The drill bit of claim 4 wherein the second exposed portions are generally hemispherical and the radius of curvature of the second exposed portions is appreciably larger than the radius of curvature of the first exposed portions.

6. The drill bit of claim 1 wherein the first base portions and the second base portions are generally cylindrical and the diameter of the second base portions is larger than the diameter of the first base portions.

7. The drill bit of claim 6 wherein the diameter of the second base portions is larger than the diameter of the first base portions by at least 3 mm.

8. The drill bit of claim 6 wherein the diameter of the first base portions is about 19 mm.

9. The drill bit of claim 6 wherein the diameter of the second base portions is about 22 mm.

10. The drill bit of claim 6 wherein the diameter of the second base portions is about 15% larger than the diameter of the first base portions.

11. The drill bit of claim 6 wherein the area of the cross-section of the second base portions is at least about 97 sq. mm. larger than the area of the cross-section of the first base portions.

12. The drill bit of claim 1 wherein the first and second base portions are that portion of the first and second inserts that are gripped by the bit head and the first and second exposed portions are the remainder of the first and second inserts, the height of the second exposed portions along their insert axis longer than the height of the first exposed portions along their insert axis.

13. The drill bit of claim 1 wherein the standoff of the second inserts is larger than the standoff of the first inserts.

14. The drill bit of claim 1 wherein the second profiles are different from the first profiles such that the superhard material on the second exposed portions better resists failure than if the superhard material were on the first exposed portions.

15. The drill bit of claim 1 wherein the first exposed portions are enhanced with a superhard material.

16. The drill bit of claim 1 wherein the second exposed portions are enhanced by having a layer of the superhard material over at least a portion thereof.

17. The drill bit of claim 1 wherein the superhard material is comprised of polycrystalline diamond.

18. The drill bit of claim 1 wherein the gage row only contains second inserts.

19. The drill bit of claim 1 wherein some of the second inserts are located on the bit head radially inward of the gage row.

20. The drill bit of claim 1 wherein the second profiles are different from the first profiles such that the second inserts better resist irregular side impact loading than the first inserts.

21. The drill bit of claim 1 wherein the second profiles are different from the first profiles such that upon rotation of the bit during drilling, the second inserts advance across the formation with less resistance than the first inserts.

22. The drill bit of claim 5 wherein:

(a) at least some of the first and second exposed portions are enhanced with a superhard material having a thickness; and (b) the ratio of the thickness to the radius of curvature of the second exposed portions is less than the ratio of the thickness to the radius of curvature of the first exposed portions.

23. The drill bit of claim 1, wherein the first inserts and second inserts are arranged to adjust a load in view of a gradient in a compressive strength of an earthen formation across a bottom hole pattern of the drill bit.

24. A percussion drill bit for percussion drilling in a formation, comprising:

a) a bit head for percussive impact against the formation;

b) at least a first plurality of first inserts and a second plurality of second inserts extending from the bit head;

c) each of the first inserts having a first base portion that is not superhard mounted to the bit head and a first exposed portion extending from the bit head, the first exposed portion having a first profile and a first contact area and generally having a radius of curvature;

d) each of the second inserts having a second base portion mounted to the bit head and a second exposed portion extending from the bit head, each of the second exposed portions having a second profile that is appreciably different from the first profile, generally having a radius of curvature and having a second contact area that is appreciably larger than the first contact area of the first exposed portion, at least some of the second exposed portions enhanced with a superhard material, wherein the bit head defines a first plurality of first cavities in which the first plurality of first inserts are disposed, and a second plurality of second cavities in which the second plurality of second inserts are disposed, wherein the depth of the second cavities is greater than the depth of the first cavities such that base planes of two adjacent cavities that are selected one each from the first cavities and the second cavities do not intercept in a bit section between the two adjacent cavities; and e) wherein the bit head has a periphery with a gage row having at least some of the second inserts located therein, and the gage row further comprises at least some of the first inserts.

25. The drill bit of claim 24 wherein the first exposed portions are generally proportional to the second exposed portions.

26. The drill bit of claim 24 wherein the first exposed portion is generally hemispherical.

27. The drill bit of claim 26 wherein the second exposed portion is generally hemispherical.

28. The drill bit of claim 24 wherein the first base portion and the second base portion are generally cylindrical and the diameter of the second base portion is appreciably larger than the diameter of the first base portion.

29. The drill bit of claim 28 wherein the diameter of the second base portion is larger than the diameter of the first base portion by at least 3 mm.

30. The drill bit of claim 28 Wherein the diameter of the first base portion is about 19 mm.

31. The drill bit of claim 28 wherein the diameter of the second base portion is about 22 mm.

32. The drill bit of claim 28 wherein the diameter of the second base portion is about 15% larger than the diameter of the first base portion.

33. The drill bit of claim 28 wherein the area of the cross-section of the second base portion is at least about 97 sq. mm. larger than the area of the cross-section of the first base portion.

34. The drill bit of claim 24 wherein the first and second base portions are that portion of the first and second inserts that are gripped by the bit head and the first and second exposed portions are the remainder of the first and second inserts, the height of the second exposed portions along their insert axis longer than the height of the first exposed portions along their insert axis.

35. The drill bit of claim 24 wherein the standoff of the second inserts is larger than the standoff of the first inserts.

36. The drill bit of claim 24 wherein the radius of curvature of the second exposed portion is larger than the radius of curvature of the first exposed portions such that the superhard material on the second exposed portions better resists failure than if the superhard material were on the first exposed portions.

37. The drill bit of claim 24 wherein the first exposed portion is enhanced with a superhard material.

38. The drill bit of claim 24 wherein the second exposed portion is enhanced by having a layer of the superhard material over at least a portion thereof.

39. The drill bit of claim 24 wherein the superhard material is comprised of polycrystalline diamond.

40. The drill bit of claim 24 wherein the gage row only contains second inserts.

41. The drill bit of claim 24 wherein some of the second inserts are located on the bit head radially inward of the gage row.

42. The drill bit of claim 24 wherein the radius of curvature of the second exposed portions is larger than the radius of curvature of the first exposed portions such that the second inserts better resist irregular side impact loading than the first inserts.

43. The drill bit of claim 24 wherein the radius of curvature of the second exposed portions is larger than the radius of curvature of the first exposed portions such that upon rotation of the bit during drilling, the second inserts advance across the formation with less resistance than the first inserts.

44. The drill bit of claim 24 wherein:

(a) at least some of the first and second exposed portions are enhanced with a superhard material having a thickness; and (b) the ratio of the thickness to the radius of curvature of the second exposed portions is less than the ratio of the thickness to the radius of curvature of the first exposed portions.

45. The drill bit of claim 24 wherein the first inserts and second inserts are arranged to adjust a load in view of a gradient in a compressive strength of an earthen formation across a bottom hole pattern of the drill bit.

46. A percussion drill bit for percussive drilling in a formation, comprising:

(a) a bit head for percussive impact against the formation;

(b) at least a first plurality of first inserts and a second plurality of second inserts extending from the bit head;

(c) each of the first inserts having a first base portion that is not superhard mounted to the bit head and a first exposed portion extending from the bit head, each of the first exposed portions having a first contact area and a first profile, and each of the first base portions being generally cylindrical with a diameter;

(d) each of the second inserts having a second base portion mounted to the bit head and a second exposed portion extending from the bit head, each of the second exposed portions having a second profile that is appreciably different than the first profile and having a second contact area that is appreciably larger than the first contact area, and each of the second base portions being generally cylindrical with a diameter that is appreciably larger than the diameter of the first base portion, at least some of the second exposed portions enhanced with a superhard material, wherein the bit head defines a first plurality of first cavities in which the first plurality of first inserts are disposed, and a second plurality of second cavities in which the second plurality of second inserts are disposed, wherein the depth of the second cavities is greater than the depth of the first cavities such that base planes of two adjacent cavities that are selected one each from the first cavities and the second cavities do not intercept in a bit section between the two adjacent cavities; and e) wherein the bit head has a periphery with a gage row having at least some of the second inserts located therein, and the gage row further comprises at least some of the first inserts.

47. The drill bit of claim 46 wherein the first exposed portions are generally proportional to the second exposed portions.

48. The drill bit of claim 46 wherein the first exposed portions are generally hemispherical.

49. The drill bit of claim 48 wherein the second exposed portions are generally hemispherical.

50. The drill bit of claim 46 wherein the diameter of the second base portions is larger than the diameter of the first base portions by at least 3 mm.

51. The drill bit of claim 46 wherein the diameter of the first base portions is about 19 mm.

52. The drill bit of claim 50 wherein the diameter of the second base portions is about 22 mm.

53. The drill bit of claim 46 wherein the diameter of the second base portions is about 15% larger than the diameter of the first base portions.

54. The drill bit of claim 46 wherein the area of the cross-section of the second base portions is at least about 97 sq. mm. larger than the area of the cross-section of the first base portions.

55. The drill bit of claim 46 wherein the first and second base portions are that portion of the first and second inserts that are gripped by the bit head and the first and second exposed portions are the remainder of the first and second inserts, the height of the second exposed portions along their insert axis longer than the height of the first exposed portions along their insert axis.

56. The drill bit of claim 46 wherein the standoff of the second inserts is larger than the standoff of the first inserts.

57. The drill bit of claim 46 wherein the first exposed portions are enhanced with a superhard material.

58. The drill bit of claim 46 wherein the second exposed portions are enhanced by having a layer of the superhard material over at least a portion thereof.

59. The drill bit of claim 46 wherein the superhard material is polycrystalline diamond.

60. The drill bit of claim 46 wherein the gage row only contains second inserts.

61. The drill bit of claim 46 wherein some of the second inserts are located on the bit head radially inward of the gage row.

62. The drill bit of claim 46 wherein the first inserts and second inserts are arranged to adjust a load in view of a gradient in a compressive strength of an earthen formation across a bottom hole pattern of the drill bit.

* * * * *